United States Patent [19]

Kawamura et al.

[11] Patent Number: 4,974,339

[45] Date of Patent: Dec. 4, 1990

[54] CLOTHES DRYER

[75] Inventors: Tamotsu Kawamura, Yokaichi; Tatsuya Hirota, Kyoto; Kiyokazu Fujikawa, Shiga; Yoshiaki Aoki, Otsu; Kouichi Tanaka, Otsu; Yozo Kawamura, Otsu, all of Japan

[73] Assignee: Sanyo Electric Co., Ltd., Osaka, Japan

[21] Appl. No.: 344,316

[22] Filed: Apr. 27, 1989

[30] Foreign Application Priority Data

May 7, 1988 [JP] Japan ..... 63-110703
Jul. 28, 1988 [JP] Japan ..... 63-189108

[51] Int. Cl.[5] ..... F26B 21/06
[52] U.S. Cl. ..... 34/73; 34/133
[58] Field of Search ..... 34/130, 133, 242, 131, 34/73, 76, 77, 78

[56] References Cited

FOREIGN PATENT DOCUMENTS 32998 2/1983 Japan .
57099 4/1983 Japan .
56518 1/1985 Japan .
284300 12/1986 Japan .

*Primary Examiner*—Henry A. Bennet
*Attorney, Agent, or Firm*—Darby & Darby

[57] ABSTRACT

A clothes dryer having a body with heater therein and a rotatable drying chamber is provided with a dual side rotating bladed heat exchange type fan having in its outer portion a group of grooves; and a partition member having an opening whose inner surface is opposed to the outer surface of said dual side bladed fan for separating paths of heated air and cooling air together with said dual side bladed fan in said body; the partition member has a group of fixed grooves interleaved with the fan rotating grooves to form a labyrinth seal; the fixed grooves extend from a base or the partition member and have a rising portion extending in the heated air path to inhibit the leakage of heated air from the heated air path to the cooling air path and have an opening to provide communication between the heated air and the cooling air.

11 Claims, 8 Drawing Sheets

CLOTHES DRYER

BACKGROUND OF THE INVENTION (i) Field of the Invention

The present invention relates to a clothes dryer and, more specifically, it relates to a dehumidifying type or condensation type clothes dryer which has a dual side bladed fan of heat exchange type for circulating heated air in a drying chamber while taking in or out the external air as cooling air. The fan serves as a heat exchanger between the heated air and the cooling air to remove moisture from the heated air. Then, the heated air is re-heated by a heater and is supplied to the drying chamber.

(ii) Description of the Prior Art

An example of a clothes dryer of the above stated type is disclosed in Japanese Pat. Publication No. 56518/1985. The dryer is provided with an air duct at an outlet of a tumbling drum, or a drying chamber. The air duct has an opening at its rear portion, and a heat exchange type dual side bladed fan is provided with in the opening to partition off the air duct. A seal member is interposed between the periphery of the dual side bladed fan and a lip of the duct opening to air-tightly separate a duct into a front path for heated air and a rear path for cooling air. When the dual side bladed fan is rotated in drying operation, heated air is circulated in the drying chamber with the front surface of the dual side bladed fan while cooling air, or the external air being taken in or out to come in contact with the rear surface of the dual side bladed fan. Thus, heated air and cooling air are subjected to a heat exchange, and water obtained from the heated air is collected in the heated air path.

Meanwhile, although the sealing member is inserted, the paths for heated air and for cooling air may communicate with each other because of the vibration of the rotating fan or its small displacement in the direction of thrust. When heated air leaks into the cooling air path and moisture in the heated air condenses into water, for example, the water cannot be collected together with the water in the heated air path. On the other hand, the heated air leaks out of the dryer without condensation, the environmental air around the dryer comes to have high humidity.

A dryer disclosed in Japanese Pat. Laid-Open No. 32998/1983 and Japanese Pat. Laid-Open No. 57099/1983 is provided with a clearance between the periphery of a heat exchange type dual side bladed fan and an opposite partition to form a bent path so that high seal effect can be obtained. Also, a dryer disclosed in Japanese Patent Laid-Open No. 284300/1986 is provided with a labyrinth seal between a fan and a partition so that the rotational force of the fan is not reduced due to the friction force in sealing.

However, with regard to the prior art seal, heated air unavoidably leaks from one side of the dual side bladed fan to the other, that is, from a path for heated air to a path for cooling air. As a result, the rate of water obtained through condensation of moisture in heated air, or the dehumidifying (condensation) rate is lower than 50%.

Accordingly, it is an object of the present invention to provide a clothes dryer which employs the labyrinth seal having a relatively good seal effect to inhibit leakage of heated air and improve the dehumidifying rate.

It may be considered that a top panel of a dryer or electrical devices within the dryer machine is cooled off using cooling air flowing the above mentioned cooling air path. However, when an opening is made in a part of the wall of the cooling air path to divide a stream of cooling air, the pressure within the cooling air path comes to be lower than that within the heated air path. This may cause water produced through condensation at a seal portion or water running down thereon to be pushed out into the cooling air path.

Accordingly, it is another object of the present invention to provide a clothes dryer which employs a labyrinth seal having a relatively good seal effect to ensure a cooling effect so that water removed from heated air can be assuredly held with in the heated air path.

SUMMARY OF THE INVENTION

A clothes dryer according to the present invention comprises a clothes dryer body having a heater therein; a drying chamber rotatably provided in the body, for drying clothes therein; a dual side bladed fan of heat exchange type rotatably provided opposed to the drying chamber in the body, having a circulation surface for circulating heated air through the heater in the drying chamber and a cooling surface at the back of the circulation surface for taking cooling air in and out of the body, for exchanging heat between the heated air circulating and the cooling air therein; the dual side bladed rotating fan having in the outer portion a group of grooves which are concentric and circular and of which openings are opposed to the heated air path, and a partition member having an opening whose inner surface is opposed to the outer surface of the dual side bladed fan, for separating paths of the heated air and the cooling air together with the dual side bladed fan in the body; the partition member having in the inner portion a group of fixed grooves which are concentric and circular and of which openings are opposed to the cooling air path the fixed grooves are interleaved with the rotating grooves in labyrinth by mating them with a small play; the fixed grooves having a rising portion rising into the heated air path on the bottom portion; the rising portion having a hole through which the fixed grooves communicates with the heated air path at the end in air flow direction.

The present invention is concerned with the provision of a clothes dryer having a heat exchange type dual side bladed fan at an opening of a partition member provided within its body. Although the dual side bladed fan rotates but not the partition member, it is necessary to separate paths for heated air and for cooling air by means of the partition member in a sealing manner. Accordingly, in the clothes dryer according to the present invention, the inner portion of the opening of the partition member and the peripheral portion of the dual side bladed fan are provided with engagement a labyrinth seal.

According to the present invention, the labyrinth seal structure includes a special aperture for communicating a cooling air path with a heated air path to form air flow from the cooling path to the heated air path so that the heated air does not leak in the cooling air path, or out of the body.

That is, according to the present invention, a group of fixed grooves, which compose the labyrinth seal structure with the group of rotating fan grooves, have at the bottom a rising portion projecting into the heated air path. The communicating aperture is formed in the air-downstream end portion of the rising portion.

Furthermore, according to the present invention, the fixed grooves of the labyrinth seal engagement have a hole at the lowermost part for leading water produced by condensation to the heated air path, the cooling air path provided with a wall for surrounding at least a part of the labyrinth engagement, a part of the surrounding wall corresponding to the hole is narrowed so that the cooling air path is decreased in diameter and the surrounding wall has a ventilation hole for dividing cooling air flow at part after the narrower part relative to the rotational direction, whereby either the heated air or water produced by condensation does not leak out of the body.

A clothes dryer according to another aspect of the present invention comprises a clothes dryer body having a heater therein; a drying chamber rotatably provided in the body, for drying clothes therein., a dual side bladed fan of centrifugal type rotatably provided opposed to the drying chamber in the body, having a circulation surface for circulating heated air through the heater in the drying chamber and a cooling surface at the back of the circulation surface for taking cooling air in and out of the body, for exchanging heat between the circulating heated air and the cooling air therein; the dual side bladed fan having in the outer portion a group of grooves; and a partition member having an opening of which inner surface is opposed to the outer surface of the dual side bladed fan, for separating paths of the heated air and the cooling air together with the dual side bladed fan in the body; the partition member having in the inner portion a group of fixed grooves which are interleaved with the rotating grooves in labyrinth by mating them with a small play; the fixed grooves have a hole at the lowermost part for leading water produced by condensation to the heated air path; the cooling air path provided with a wall for surrounding the labyrinth seal, a part of the surrounding wall corresponding to the hole is narrowed so that the cooling air path is decreased in diameter and the surrounding wall has a ventilation hole for dividing cooling air flow at part after the narrowed part relative to the fan rotational direction.

DETAILED DESCRIPTION OF THE PREFERRED EMBODIMENTS

Figure 1:
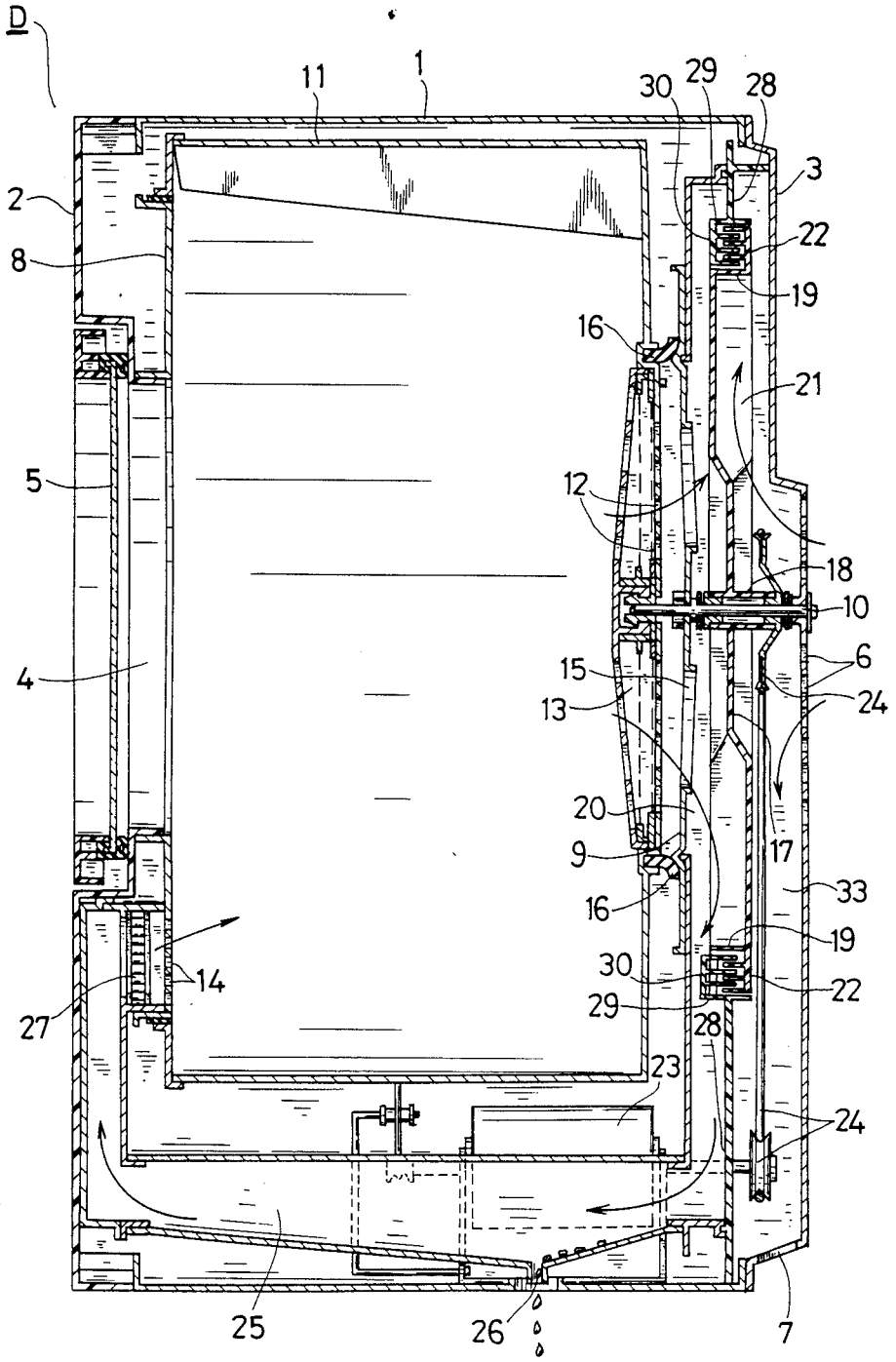
FIG. 1 is a sectional side view showing an embodiment of a clothes dryer according to the present invention.
Figure 2:
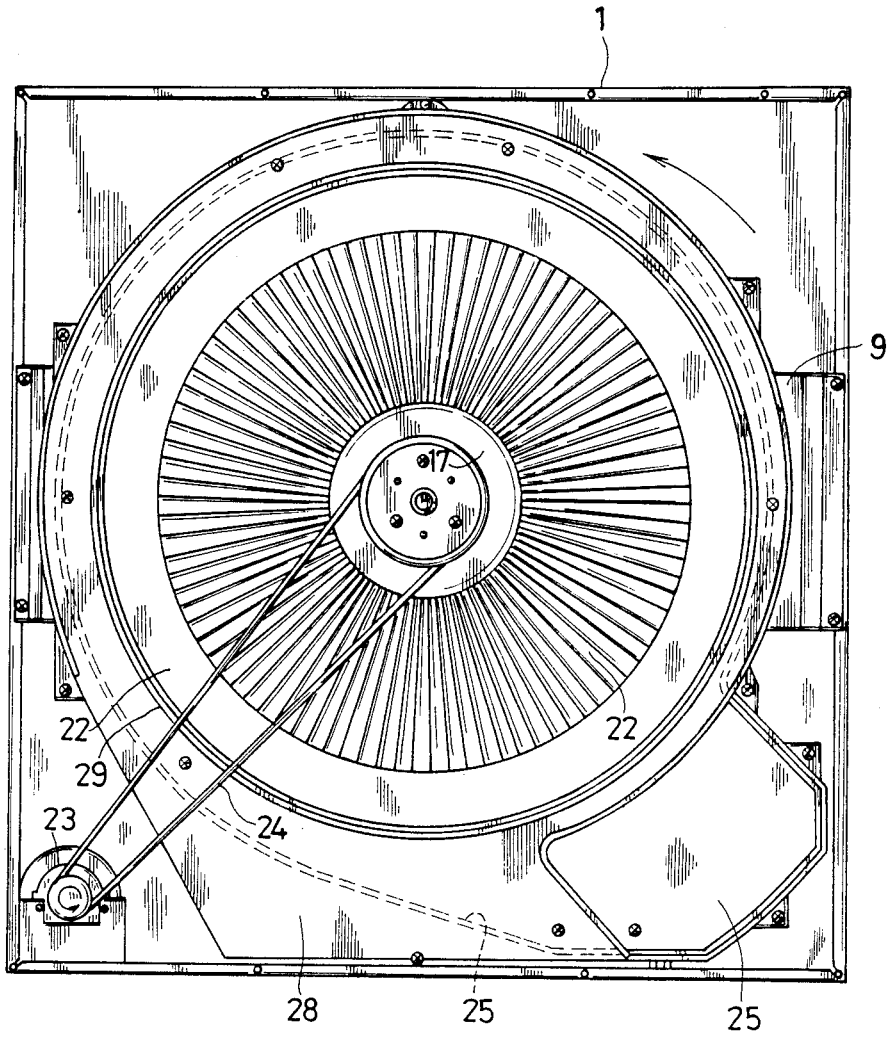
FIG. 2 is a rear elevation view showing the embodiment with a rear plate being eliminated.

A clothes dryer according to the present invention basically comprises a clothes dryer body having a heater therein; a drying chamber rotatably provided in the body, for driving clothes therein; a dual side bladed fan of heat exchange type rotatably provided opposed to the drying chamber in the body, having a circulation surface for circulating heated air through the heater in the drying chamber and a cooling surface at the back of the circulation surface for taking cooling air in and out of the body, for exchanging heat between the heated air circulating and the cooling air therein; the dual side bladed rotating fan having in the outer portion a group of grooves which are concentrically circular and of which openings are opposed to the heated air path; and a partition member having an opening of which inner surface is opposed to the outer surface of the dual side bladed fan, for separating paths of the heated air and the cooling air together with the dual side bladed fan in the body., the partition member having in the inner portion a group of fixed grooves which are concentrically circular and of which openings are opposed to the cooling air path, the fixed grooves are interleaved with the rotating grooves in labyrinth by mating them with a small play.

It is intended that the present invention not be limited to the particular embodiment as disclosed below, but that various changes and modifications may be made and equivalents may be substituted for elements of the following preferred embodiment without departing from the true scope of the invention. The equivalent elements include ones that have traditionally been employed and that will be employed in future for the same purpose.

According to the present invention, the labyrinth seal structure provided between the dual side bladed fan and the partition member preferably comprises a group of rotating grooves on the peripheral portion of the dual side bladed fan and a group of fixed grooves on the inner portion of the opening of the partition member. Preferably, both the groups have two -to four grooves integrally formed in parallel manner.

Embodiments according to the present invention will now be described in conjunction with the drawings.

EMBODIMENT 1

Referring to FIGS. 1 to 6, a front panel 2 and a rear panel 3 are secured to edges of front and rear openings of a housing 1 of a clothes dryer D, respectively. The front panel 2 is provided with a clothes insertion and withdrawal opening 4 which may be opened and closed by a door 5. In the rear panel 3, an inlet 6 for cooling air, or the external air, is formed in the center portion and an outlet 7 is formed in the lower portion. In the vicinity of the clothes insertion and withdrawal opening 4, an annular drum support member 8 made of metal is fixed enclosing the opening 4. A laterally elongate support plate 9 made of metal is fixed within the dryer housing 1 spaced from the rear panel 3. The drum support member g and the support plate 9 are secured to the dryer housing 1.

A support shaft 10 extends in the transverse direction between the respective middle positions of the rear panel S and support plate 9, and it is fixed to the rear panel 3 with a bolt. A horizontal shaft type tumbling drum 11, which defines a drying chamber receiving clothes and tumbling them dry, has its front opening opposed to the clothes insertion and withdrawal opening 4, is supported rotatably through felt or the like by the drum support member 8, and has its rear wall rotatably held through a bearing by the support shaft 10 extending through the support plate 9. Heated air outlets 12 are formed at the center portion of the rear wall and a lint filter 13 detachably covers thereover. Heated air inlets 14 are formed on the drum support member 8.

The support plate 9 opposed against the outlets 12 is provided with an air hole 15. A seal member 16 is attached to the rear wall of the drum 11 in slidably contact with the support plate 9 to air-tightly seal a passage between the outlet 12 and the air hole 15.

A heat exchange type dual side bladed fan 17 is rotatably attached through the bearing to the support shaft 10 extending between the rear panel 3 and the support plate 9. The dual side bladed fan 17 is formed with radial blades from a rotational cylinder 18 at the center to an annular peripheral portion 19, so that a circulation surface 20 facing to the support panel 9 and a cooling surface 21 facing to the rear panel 3 are provided. A group of grooves 22, illustratively shown as three rotating grooves commonly occupying the peripheral portion 19 having a shape of concentric circular arc, are formed toward the periphery in the peripheral portion 19. The group of rotating grooves—22 have openings facing to the support plate 9. The dual side bladed fan 17 is molded of resin as a unity with the rotation cylinder 18, the peripheral portion 19, the respective fans 20, 21 and the group of rotating grooves 22.

A motor 23 is disposed on the right lower corner in the dryer housing 1, which causes the drum 11 to rotate at a low speed with a pulley-belt while causes the dual side bladed fan 17 to rotate at a high speed with a pulley-belt 24. Both the drum 11 and the fan 17 rotate counter-clockwise, seen from the rear.

The support plate 9 serves as a wall of a heated air path 25 positioned at the lower right corner (seen from the rear) in the dryer housing 1, for circulating heated air. The path 25 runs from the outlet 12 through the air hole 15 and the circulation surface 20 to the inlet 14. In the course, a drain pipe 26 is provided to discharge the water removed from heated air, and a heater 27 consisting of a positive temperature coefficient thermister is disposed in the vicinity of the inlet 14.

A partition member 28 is provided to cover the periphery of the dual side bladed fan 17 and partition off the heated air path 25, and its annular inner portion 29 is opposed to the group of rotating grooves 22. A group of fixed grooves 30, illustratively three fixed grooves commonly occupying the inner portion 29 having a shape of concentric circular arc, is formed toward the center in the inner portion 29. The group of fixed grooves 30 has respective openings opposed to the rear panel 3 and are interleaved with clearance to the group of rotating grooves 22 in non-contact with each other. As a result, the group of rotating grooves 22 and the group of fixed grooves 30 make a labyrinth seal.

Figure 3:
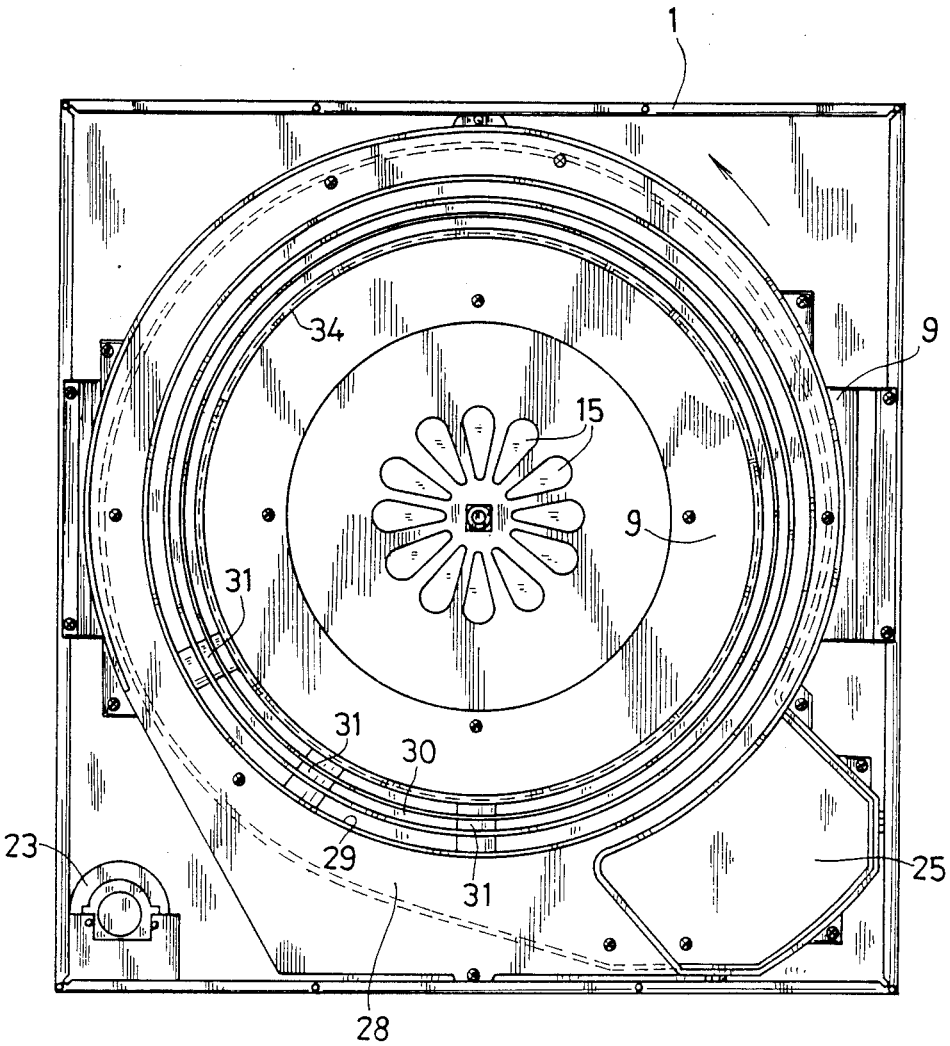
FIG. 3 is a rear elevation view showing the embodiment with the rear plate and a dual side bladed fan being eliminated.

The group of fixed grooves 30 has three rising portions 31 formed integrally with its base portion, or with the side wall of the heated air path 25. The rising portions 31 are disposed at the lowermost position of the group of fixed grooves 30, preferred the positions of portions 31 (as seen in FIG. 3) being in the range approximately 360° from the lower drum position in the direction of drum rotation. Each of the rising portions 31 rises spreading out toward the end in the rotational direction. In the rising portions 31, respective grooves communicate with each other. The end rising at the maximum height, or the downstream end with regard to the flow of heated air has each groove provided with a communication aperture 32. The aperture 32 provides communication between each groove of the group of fixed grooves 30 and the heated air path 25.

Thus, the heated air path 25 and the cooling air path 33 are separated from each other by the dual side bladed fan 17 and the partition member 28.

In the drying operation, the heater 27 is actuated and the motor 23 is also actuated to rotate the tumbling drum 11 at a low speed and the dual side bladed fan 17 at a high speed in counter-clockwise direction (seen from the rear), respectively. Heated air circulates along the heated air path 25 while cooling air passes in and out through the cooling air path 33. Clothes give off steam by applying heat and heated air carries the steam. The steam is cooled down on the dual side bladed fan 17 to condense into water. Water runs down through the heated air path 25 and is discharged from the drain pipe 26 to the outside.

The heated air path 25 and cooling air path 33 are separated with the labyrinth seal. Within the heated air path 25, heated air flows along the inclination of the rising portions 31. The heated, air path 25 is narrowed because of the rising portions 31. This partially increases the velocity of heated air in accordance with Bernoulli's theorem. In this way, the pressure within the heated air path 25 becomes lower with the aperture 32 intervening between those paths so that the air within each groove of the group of fixed grooves 30 is lead from the aperture 32 to the heated air path 25. Leakage of heated air from the heated air path 25 to the cooling air path 33 is inhibited by braking the balance of pressure.

Further, water produced through a heat exchange between the group of rotating grooves 22 and the group of fixed grooves 30 is lead to the heated air path 25 due to the air flow from each aperture 32. Flow rate of the air from the aperture 32 and pressure ca be adjusted by changing a extent of protrusion of the rising portions 31.

Thus, dehumidification through a heat exchange of heated air can be sufficiently and assuredly carried out by virtue of less leakage of heated air, and operation efficiency can be improved.

It is also possible that one of the rising portions 31 at the lowermost position is provided with a passage which provides a vertical communication between grooves of the group of fixed grooves 30 so that water generated within the grooves, runs down around the grooves independent of the air flow to pass out to the heated air path 25. The number of the rising portions 31 may be determined as desired, but 2–6 of them are preferable.

In this embodiment, the rising portions 31 are arranged in position along a tangent line toward the heated air path 25 so as to increase a flow rate of heated air, whereby flow force of the air from the aperture 32 is enhanced.

In this embodiment, the dual side bladed fan 17 is provided with the annular peripheral portion 19 to ensure the overall strength of the fan in manufacturing blades. Also, the peripheral portion 19 is utilized as a part of the group of rotating grooves 22.

Figure 4:
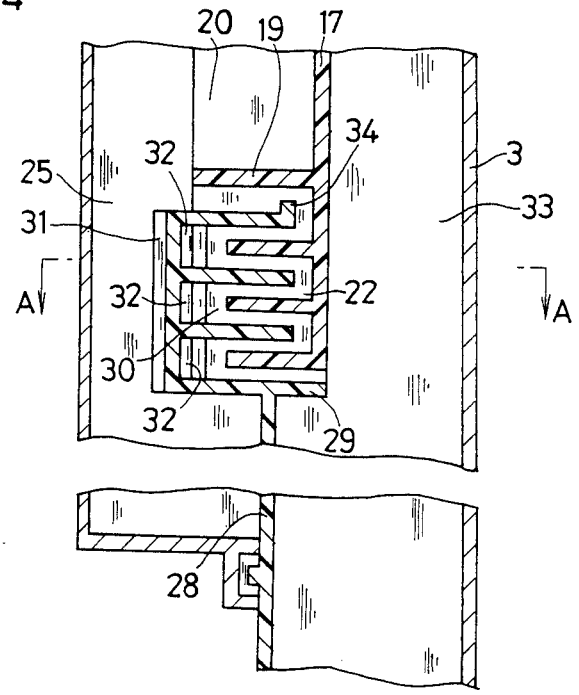
FIG. 4 is an enlarged sectional side view of a main portion of the embodiment.
Figure 5:
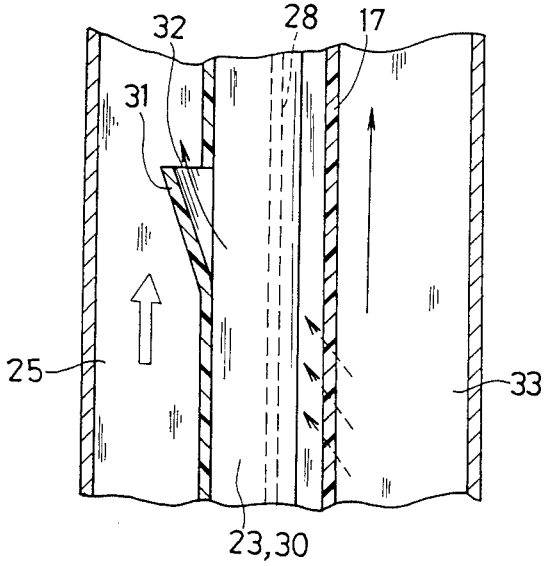
FIG. 5 is a sectional view along the line A—A of FIG. 4.
Figure 6:
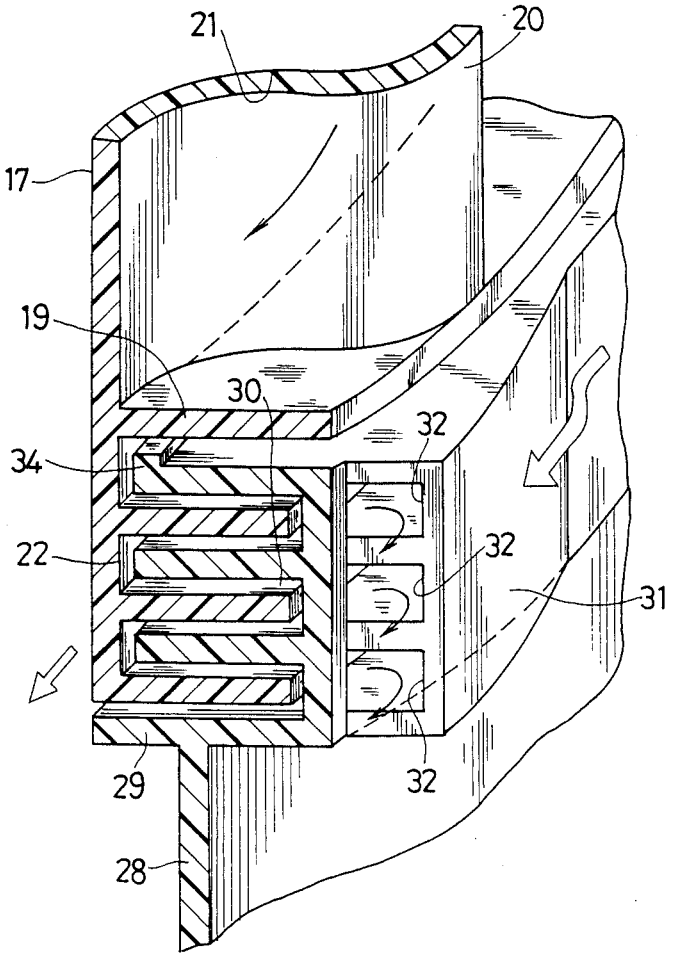
FIG. 6 is a perspective view of the main portion.

Referring now to FIGS. 4 and 6, a rib 34 for preventing intrusion of water drops is formed on the peripheral surface of a groove of the group of fixed grooves 30 closest to the rotational center of the dual side bladed fan 17 (Height: 5 mm, Width: 2 mm, Clearance between the above inner surface of the groove of the group of rotating groove 30 and the rib 34: 2 mm).

With the rib 34, intrusion of water drops from the heated air path 25 can be avoided. Specifically, clothes exhales steam when heated through the heater 27, and the steam condenses on the surface of the circulation surface of the dual side bladed fan 17 into water. The water is scattered against the circulation casing, or the partition member 28, with centrifugal force. However, when a balance of the air is lost to some extent due to the thermal deformation of the fan, water drops in a groove of the labyrinth may move from the heated air path to the cooling air path. The rib 34 stops the intrusion of the small amount of water. Further, a water drop stopped by the rib 34 is kept between the peripheral portion 19 and the rib 34 due to surface tension, so that the labyrinth effect is enhanced while increased resistance in air flow improves the dehumidifying rate. Without the rib 34, the above mentioned advantages are lost, so that water drops intruding into the groove of the labyrinth moves from the heated air path to the cooling air path fast. However, the aperture 32 provided in accordance with Bernoulli's theorem forces those water drops back to the heated air path 25. When all the drops can not be sent back, some of them may leak in the cooling air path and drain off the dryer machine. Provision of the rib 34 has an effect to eliminate such drawbacks. The optimum part to which the rib 34 is to be positioned is the edge of the wall of the groove. This is because the fan is so structured that the edge can not be deformed even when the dual side bladed fan 17 is subjected to thermal deformation. Such thermal deformation is effectuated to the half of the peripheral portion at most.

As previously described, in the clothes dryer D, the peripheral portion of a dual side bladed fan and the inner portion of a partition member are provided with a group of grooves, and they are fitted with clearance from each other to form a labyrinth seal in order to separate heated air and cooling air paths formed before and after the dual side bladed fan with the partition member. In addition to that, a group of fixed grooves is formed with a rising portion and a communication aperture to make a pressure within the cooling air path higher, so that heated air into the cooling air path can be assuredly inhibited. Consequently, a clothes dryer which attains a high dehumidifying rate and avoids worsening the environmental air around the dryer machine due to the leakage of heated air containing moisture is provided.

EMBODIMENT 2

Figure 7:
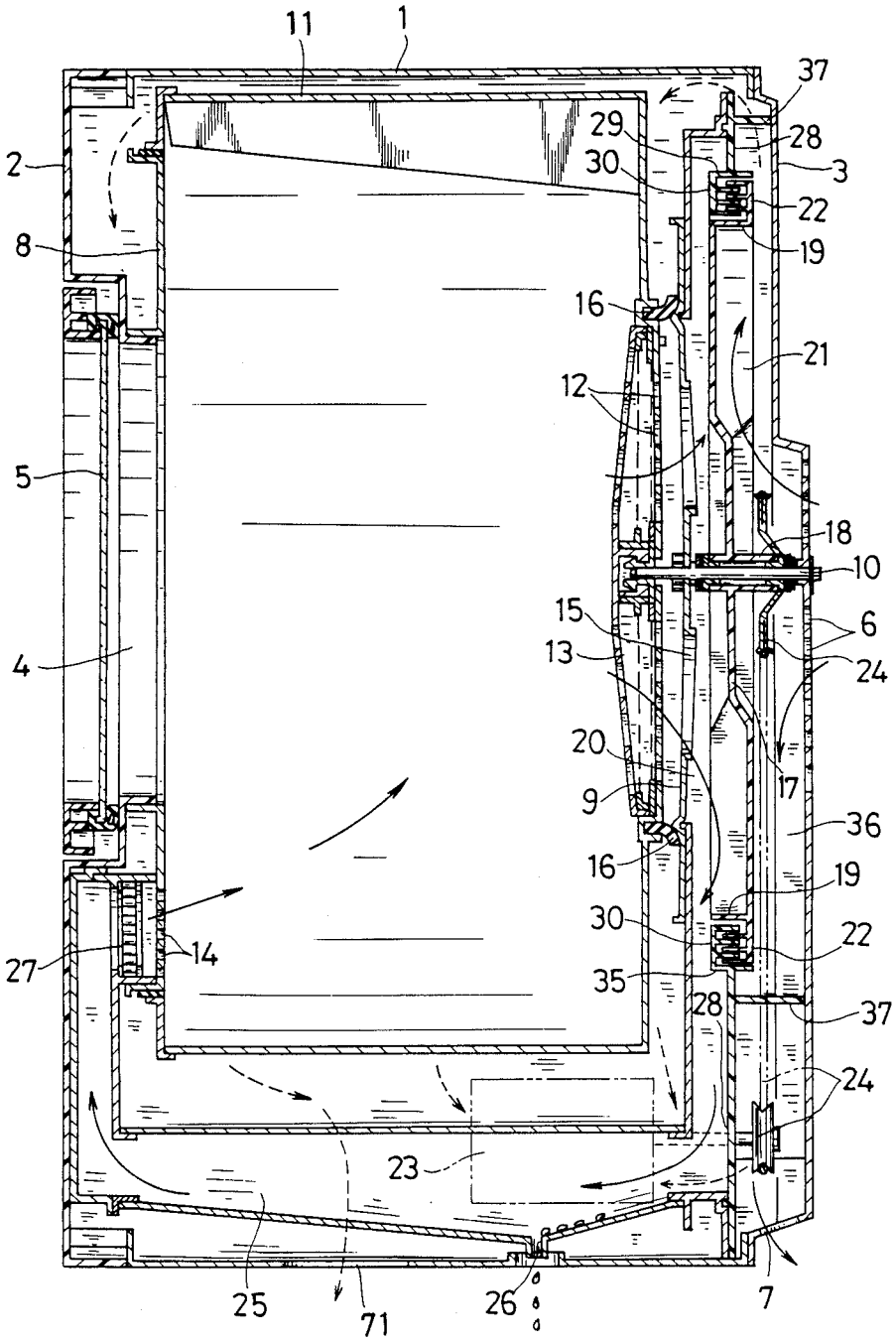
FIG. 7 is a sectional side view showing another embodiment of the clothes dryer according to the present invention.
Figure 8:
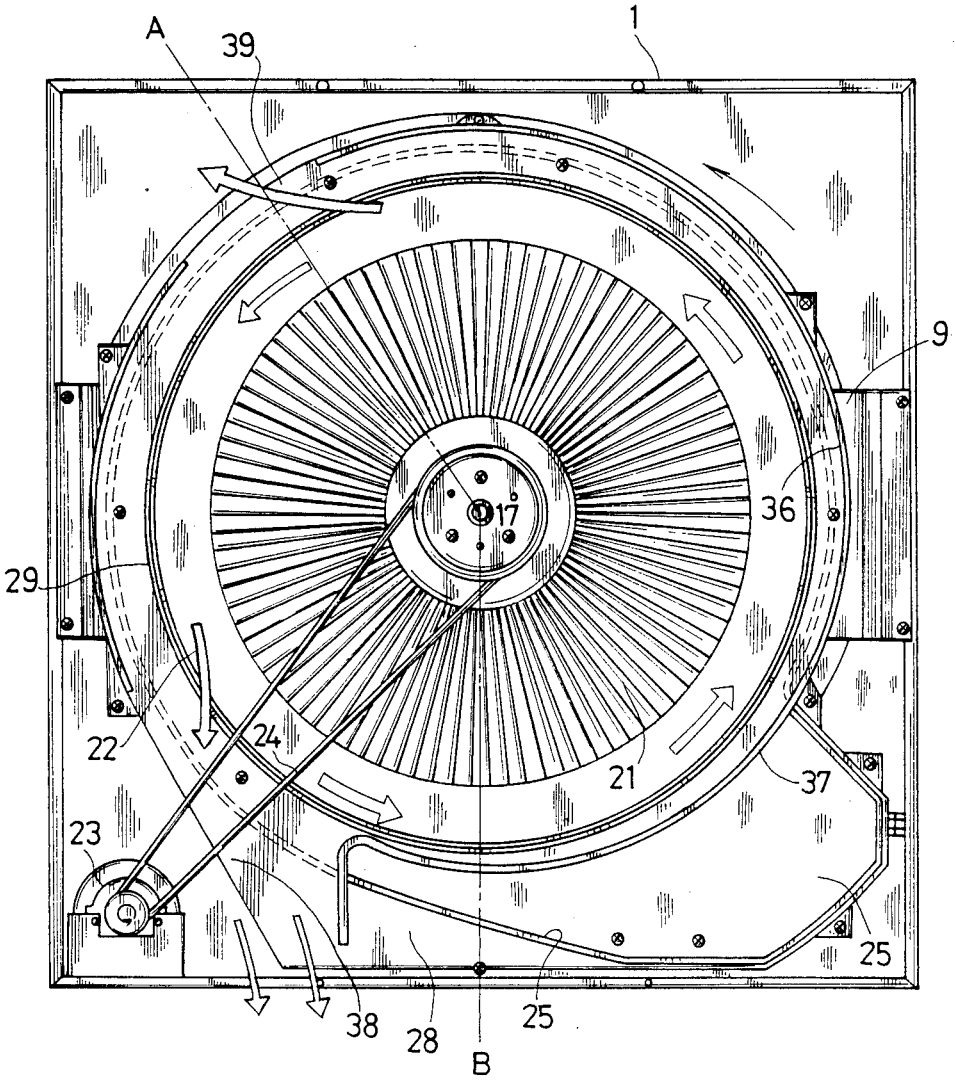
FIG. 8 is a rear elevation view of the embodiment with a rear plate being eliminated.
Figure 9:
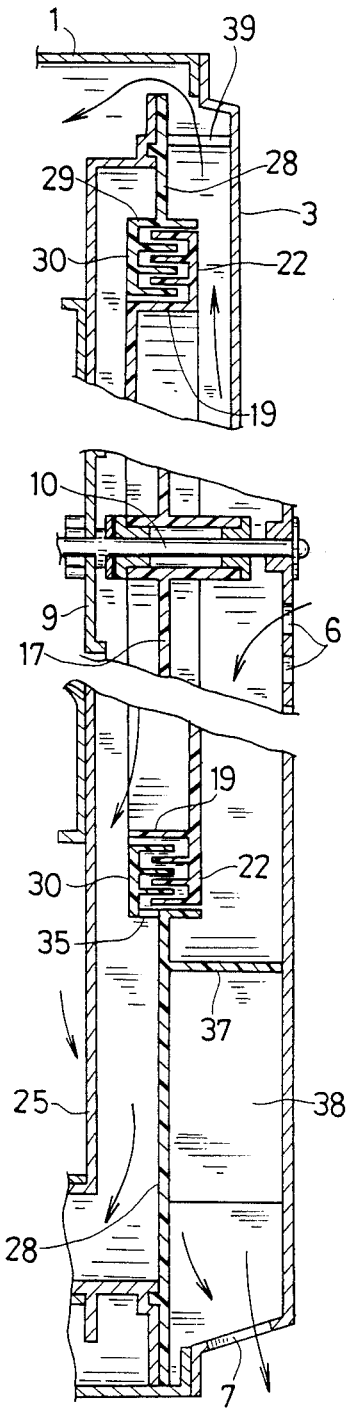
FIG. 9 is a sectional view showing a main portion of the embodiment along the line A - O - B of FIG. 8.

Referring to FIGS. 7 to 9 (corresponding parts are designated with the same reference numerals as in Embodiment 1), a front panel 2 and a rear panel 3 are secured to edges of front and rear openings of a housing 1 of a clothes dryer E, respectively. The front panel 2 is provided with a clothes insertion and withdrawal opening 4 which may be opened and closed by a door 5. In the rear panel 3, an inlet 6 for cooling air, or the external air, is formed in the center portion and an outlet 7 is formed in the lower portion. In the vicinity of the clothes insertion and withdrawal opening 4, an annular drum support member 8 made of metal is fixed enclosing the opening 4. A laterally elongate support plate 9 made of metal is fixed within the dryer housing 1 spaced from the rear panel 3. The drum support member 8 and the support plate 9 are secured to the dryer housing 1.

A support shaft 10 extends in the transverse direction between the resPective middle positions of the rear panel 3 and support plate 9, and it is fixed to the rear panel 3 with a bolt. A horizontal shaft type tumbling drum 11, which is a drying chamber receiving clothes and tumbling them dry, has its front opening opposed to the clothes insertion and withdrawal opening 4, is supported rotatably through felt or the like by the drum support member 8, and has its rear wall rotatably held through a bearing by the support shaft 10 extending through the support plate 9. Heated air outlets 12 are formed at the center portion of the rear wall of the drum and a lint filter 13 detachably covers thereover. Heated air inlets 14 are formed on the drum support member 8.

The support plate 9 opposed to the outlets 12 is provided with an air hole 15. A seal member 16 is attached to the rear wall of the drum 11 in slidably contact with the support plate 9 to air-tightly seal a passage between the outlet 12 and the air hole 15.

A heat exchange type dual side bladed fan 17 is rotatably attached through the bearing to the support shaft 10 extending between the rear panel 3 and the support plate 9. The dual side bladed fan 17 is a centrifugal fan which is formed with radial blades from a rotational cylinder 18 at the center to an annular peripheral portion 19, so that a circulation surface 20 facing to the support panel 9 and a cooling surface 21 facing to the rear panel 3 are provided. A group of rotating grooves 22, which consists of three rotating grooves commonly occupying the peripheral portion 19 having a shape of concentric circular arc, are formed in the peripheral portion 19. The group of rotating grooves 22 have openings facing to the support plate 9. The dual side bladed fan 17 is molded of resin as a unity with the rotation cylinder 18, the peripheral portion 19, the respective fans 20, 21 and the group of rotating grooves 22.

A motor 23 is disposed on the left lower corner in the dryer housing 1 (seen from the rear in FIG. 8), which causes the drum 11 to rotate at a low speed with a pulley-belt while causes the dual side bladed fan 17 to rotate at a high speed with a pulley-belt 24. Both the drum 11 and the fan 17 rotate counter-clockwise seen from the rear.

The support plate 9 serves as a wall of a heated air path 25 positioned at the lower right corner (seen from the rear in FIG. 8) in the dryer housing 1, for circulating heated air. The path 25, which is provided with a surrounding wall extending rearward, runs from the outlet 12 through the air hole 15 and the circulation surface 20 to the inlet 14. In the course, a drain pipe 26 is provided to discharge the water removed from heated air, and a heater 27 consisting of a positive temperature coefficient thermister is disposed in the vicinity of the inlet 14.

A partition member 28 is provided to cover the periphery of the dual side bladed fan 17 and partition off the heated air path 25, and its annular inner portion 29 is opposed to the group of rotating grooves 22. A group of fixed grooves 30, which consists of three fixed grooves commonly occupying the inner portion 29 having a shape of concentric circular arc, is formed in the inner portion 29. The group of fixed grooves 30 has respective openings opposed to the rear panel 3 and is fitted with clearance to the group of rotating grooves 22 in non-contact with each other. As a result, the group of rotating grooves 22 and the group of fixed grooves 30 make a labyrinth seal together. Further, a weep hole 35 is formed at the lowermost portion of the group of fixed grooves 30 to lead into the heated air path water produced through condensation at the inside and outside of the labyrinth seal and running down along it.

The above-stated partition member 28 has its peripheral portion provided with a surrounding wall 37 for sectioning the cooling air path 36. The surrounding wall 37, as seen in FIG. 8, is positioned partially surrounding the groups of rotating grooves and fixed grooves 22, 30 a wall 37 narrows to the minimum diameter at the part a little left of the part corresponding to the weep hole 35, or the lowermost part of the groups of grooves 22, 30 relative to the rotational direction (as shown by the arrow), and gradually widens in the rotational direction. Further, the surrounding wall 37 is provided with a duct 38, extending downward, for leading cooling air to the motor 23 at the part near the motor 23. It is also provided with a ventilation hole 39 on a part a little left (seen from the rear in FIG. 8) of the top portion for partially sending cooling air out to the machine body. In the drying operation, the motor 23 and the heater 27 are actuated to rotate the tumbling drum 11 at a low speed and the dual side bladed fan 17 at a high speed in counter-clockwise direction (seen from the rear in FIG. 8), respectively.

The heated air path 25 and cooling air path 36 are separated by the labyrinth seal.

Heated air circulates along the heated air path 25 while cooling air passes in and out through the cooling air path 36. Clothes generate steam by applying heat and heated air carries the steam. The steam is cooled down on the dual side bladed fan 17 to condense into water. Water runs down through the heated air path 25 and is discharged from the drain pipe 26 to the outside.

Cooling air cools down the motor 23 while passing through the duct 38 to a secondary exhaust port 71, and the air partially sent out of the ventilation hole 39 cools down electrical devices within the machine body or the top plate as well as the motor 23 while passing through to the secondary exhaust port 71.

The cooling air path 36 set up by wall 37 is decreased in diameter at the part a little left (seen from the rear in FIG. 8) from the lowermost position of the groups of grooves 22, 30, and therefore pressure becomes relatively high just in this part of the cooling air path 36. The pressure within the cooling air path 36 becomes lower as it becomes more distant from the narrowed part in the rotational direction. As a result, when water produced through condensation within the labyrinth seal or water produced near the labyrinth seal and intruding thereto runs down along the groups of grooves 22, 30 to the bottom part, a high pressure from the cooling air path 36 pushes it through the weep hole 35 into the heated air path 25. Then, the water is lead to the drain pipe, to be discharged to the outside.

As previously mentioned, as a result of ensuring a cooling effect by partially sending the air out of the ventilation hole 39, the pressure for sending the air with the cooling surface 21 is made relatively high by narrowing the surrounding wall 37 of the cooling air path 36 in the vicinity of the weep hole 35, although the pressure within the cooling air path 36 would be relatively low in a conventional manner. Thus, water is collected and pushed out through weep hole 35 to the heated air path 25. In this way, humidity increase in the inside and outside of the machine is inhibited, dehumidification rate can be kept equal or more than 50%.

As described above, with the clothes dryer E, even if a part of the cooling air is used for cooling electrical devices or the like, collected water can be assuredly pushed out to the heated air path, so that a clothes dryer with high dehumidification efficiency is provided.

Further, by employing a structure of labyrinth seal as that in Embodiment 1 for the labyrinth seal in the clothes dryer E of Embodiment 2, leakage of the collected water from the dryer body as well as leakage of heated air containing moisture can be avoided.

What is claimed is:

1. A clothes dryer comprising:

a clothes dryer body having a heater therein;

a rotatable drying chamber in said body for drying clothes therein;

a rotatable dual side bladed heat exchange type fan opposed to said drying chamber in said body, said fan having a circulation surface for circulating heated air through said heater in said drying chamber and a cooling surface at the back of said circulation surface for taking cooling air in and out of said body for exchanging heat between circulating heated air and the cooling air therein; said rotating dual side bladed fan having in its outer portion a group of spaced arcuate grooves which are concentric and and whose openings portions are in communication with the heated air path; and a partition member in said body having an opening within which said dual side blade fan rotates for separating paths of said heated air and said cooling air together with said dual side bladed fan; said partition member having on its inner portion surrounding the opening a base from which extend a group of fixed arcuate grooves which are concentric and whose openings are opposed to said cooling air path, said partition fixed grooves interleaving with clearance with said rotating fan grooves to form a labyrinth seal; said partition member having an inclined rising portion extending from said base for the fixed grooves in said heated air path; said rising portion having a passage through which said fixed grooves opposed to the cooling path are connected with said heated air path at the end in a direction of air flow.

2. A clothes dryer according to claim 1, wherein said rotating grooves of the fan and fixed grooves are the same in number, between 2 to 4.

3. A clothes dryer according to claim 1, wherein said rising portion inclines to gradually spread out toward the rotational direction of said rotating grooves of the fan.

4. A clothes dryer according to claim 1, wherein a said inclined rising portion is disposed at a position in the range of approximately 300°–360° from the lowermost position of the rotating drum in the direction of its rotation.

5. A clothes dryer according to claim 4, wherein said body has a box shape and said drying chamber has an opening at the front of said box, said hated air path being located at lower left part of said body when said drying chamber and said rotating grooves of the fan rotate clockwise as seen relative to the front of the body and at the lower right part of said body with said drying chamber and rotating grooves of the fan rotating counterclockwise.

6. A clothes dryer according to claim 1, wherein said fixed grooves have a rib formed on the peripheral surface closest to the rotation center of said dual side bladed fan and projecting toward the inner surface of said opposite rotating grooves, for inhibiting intrusion of water drops.

7. A clothes dryer according to claim 1, wherein said surrounding wall is adapted to have a gradual increase in diameter along the rotational direction of said dual side bladed fan.

8. A clothes dryer comprising:

a clothes dryer body having a heater therein;

a rotatable drying chamber in said body for drying clothes therein;

a rotatable dual side bladed centrifugal type fan opposed to said drying chamber in said body, said fan having a circulation surface for circulating heated air through said heater in said drying chamber and a cooling surface at the back of said circulation surface for taking cooling air in and out of said body for exchanging heat between the circulating heated air and the cooling air therein; said rotating dual side bladed fan having in the outer portion a group of arcuate grooves; and a partition member having an opening whose inner surface is opposed to the outer surface of said dual side bladed fan, for separating paths of said heated air and said cooling air together with said dual side bladed fan in said body; said partition member having a group of fixed arcuate grooves which interleave with clearance with the rotating fan grooves to form a labyrinth; said fixed grooves of said partition member provided with a hole at the lowermost portion relative to said dryer body for discharging water produced by condensation in said heated air path, and a generally arcuate wall in said body in the cooling air path surrounding at least a part of said labyrinth seal, said wall having a section decreasing in diameter in the area of said water discharge hole of said partition member fixed grooves, said wall having a ventilation opening located above said section of decreasing diameter for dividing the flow of cooling air.

9. A clothes dryer according to claim 8, wherein said surrounding wall is adapted to have a gradual increase in diameter along the rotational direction of said dual side bladed fan.

10. A clothes dryer according to claim 1, further comprising a wall in said dryer body in the cooling air path surrounding at least a part of said labyrinth seal; said surrounding wall having a section decreasing in diameter to decrease the cooling air path volume fan, said surrounding wall also having a ventilation hole located above said section of decreasing diameter in the direction of rotation of the drying chamber for dividing cooling air flow.

11. A clothes dryer according to claim 1, wherein a hole is provided at the lowermost portion relative to said dryer body of said fixed grooves of said partition member for discharging water produced by condensation in said heated air path, and further comprising a generally arcuate wall in the cooling air path surrounding at least a part of said labyrinth seal, said wall having a section decreasing in diameter in the area of said water discharge hole of said partition member fixed grooves, said wall having a ventilation opening located above said section of decreasing diameter for dividing the flow of cooling air.

* * * * *